United States Patent [19]

Shima

[11] Patent Number: 4,510,775

[45] Date of Patent: Apr. 16, 1985

[54] FLAT KNITTING MACHINE CAPABLE OF CHANGING STITCH DENSITY

[75] Inventor: Masahiro Shima, Wakayamashi, Japan

[73] Assignee: Shima Idea Center Co., Ltd., Wakayama, Japan

[21] Appl. No.: 385,375

[22] PCT Filed: Sep. 30, 1980

[86] PCT No.: PCT/JP80/00233

§ 371 Date: May 27, 1982

§ 102(e) Date: May 27, 1982

[87] PCT Pub. No.: WO82/01199

PCT Pub. Date: Apr. 15, 1982

[51] Int. Cl.[3] ..... D04B 7/00

[52] U.S. Cl. ..... 66/77; 66/78

[58] Field of Search ..... 66/77, 78, 75.1

[56] References Cited

FOREIGN PATENT DOCUMENTS 2153429 3/1973 Fed. Rep. of Germany ..... 66/77

1405138 3/1963 France ..... 66/77

638241 4/1962 Italy ..... 66/77

*Primary Examiner*—Ronald Feldbaum

*Attorney, Agent, or Firm*—Barnes, Kisselle, Raisch, Choate, Whittemore & Hulbert

[57] ABSTRACT

The present invention relates to a flat knitting machine capable of changing the stitch size of an optional wale in every course, and this flat knitting machine comprises a selector actuator for selecting needles to be raised to a knitting or tucking position, select jack pressers for locating at lower butt positions butts of select jacks for operating needles or corresponding jacks raised to a knitting or tucking position, and a pair of upper and lower piled knitting cams, the upper knitting cam being a knitting cam for higher butts, which is brought into butting contact with higher butts, and the lower knitting cam being a knitting cam for lower butts, which is brought into butting contact with lower butts, wherein the stitch size can appropriately be changed by changing the position to which the needles are brought down by said knitting cams.

20 Claims, 7 Drawing Figures

FLAT KNITTING MACHINE CAPABLE OF CHANGING STITCH DENSITY

TECHNICAL FIELD

The present invention relates to a flat knitting machine capable of changing the stitch density. More specifically, the present invention relates to a flat knitting machine in which the size of loops of a knitted fabric can appropriately be changed in optional courses or wales and knitting is performed by appropriately changing the length in piles or combining them with misses, whereby optional changes can be given to the knitted fabric.

BACKGROUND ART

As means for appropriately changing the size of loops of courses in the flat knitting operation, there is known an apparatus in which amonng knitting cams of a flat hosiery knitting machine, loop size-changing knitting cams are disposed on both the sides of a raising cam, respectively, each of these, loop size-changing, knitting cams is formed into left and right parts so that the position can be changed, and the loop size-changing knitting cams act on higher and lower butts of latch needles or jacks independently to change the size of loops of the respective latch needles or jacks independently. In this known apparatus, the pattern of the knitted fabric is determined according to arrangement of latch needles or jacks of lower and higher butts in a needle groove, and in order to change this pattern, it is necessary to change vertical arrangement of butts of the latch needles or jacks.

DISCLOSURE OF THE INVENTION

The apparatus of the present invention comprises a needle selector for dividing needles or jacks to be raised to the tucking or knitting position into two groups, a select jack presser for locating one group of the needles or jacks at the lower butt position through a select jack, and knitting cams including a knitting cam for higher butts and a knitting cam for lower butts. The latch needles to be raised to the knitting or tucking position are divided by the needle selector into one group of needles for forming stitches of a large size and the other group of needles for forming stitches of a small size, and one group of the needles are pushed down to the lower butt position by the select jack presser. When both the knitting cams for higher and lower butts are brought down, the knitting cam for lower butts is located at a position higher than the position of the knitting cam for higher butts and the quantity of lift-up of needles corresponding to the lower butts is made smaller than the quantity of lift-up of needles corresponding to the upper butts, whereby the size of loops in one group of the needles is made different from the size of loops in the other group of the needles. If this apparatus is used, since the size of loop can appropriately be selected for respective needles in forming respective courses of a knitted fabric, it becomes possible to provide an optional stitch density for an optional portion of the knitted fabric.

Accordingly, in a texture where transfer of stitches is necessary, for example, a cable fabric, if the size of loops is increased in the portion of this texture, a beautiful knitted fabric can be obtained without imparting a unnecessary tension to yarn.

Furthermore, in a fabric comprising rib stitches and plain stitches, if the size of rib stitches is reduced and the size of plain stitches is increased, a uniform stitch density can be produced throughout the entire knitted fabric.

Moreover, in forming a pile knitted fabric, if the size of loops is changed among pile stitches, the knit pattern can be accented and an eccentric knitted fabric can be obtained. More specifically, when knitting is performed by needles of one of paired needle beds and piles are formed by needles of the other needle bed, if the knitting cams are appropriately changed, the length of piles can optionally be chosen among long length, short length and miss.

BEST MODE FOR CARRYING OUT THE INVENTION

Figure 1:
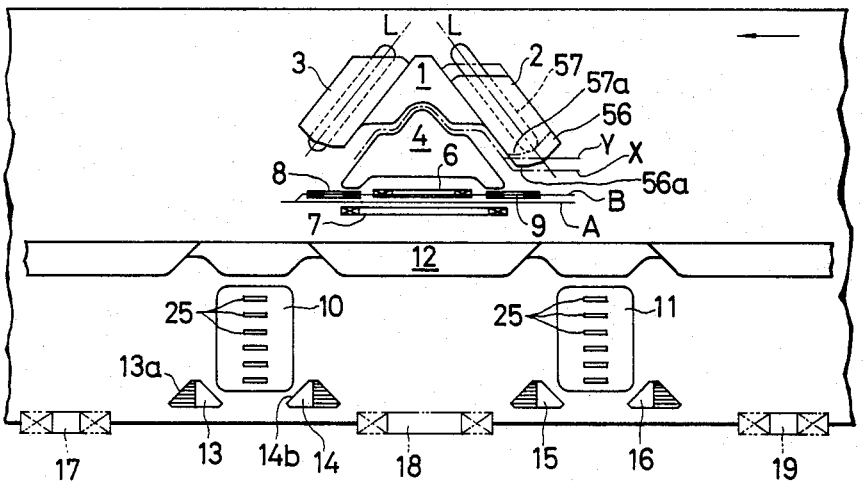
FIG. 1 is a lay-out view of a needle cam selector actuator of a carriage, which is seen from the lower face of the carriage.

FIG. 1 is a view showing arrangement of cams of a carriage, seen from the lower face of the cam. The cams are arranged laterally symmetrically. Reference numeral 1 represents a guard cam and knitting cams 2 and 3 are disposed on both the sides of the guard cam 1 so that they can slide along lines L. Reference numeral 4 represents a raising cam, and select jack pressers 6, 7, 8 and 9 are arranged below the raising cam 4. Reference numerals 10 and 11 represent selector actuators, and selector guide cams 12, 13, 14, 15 and 16 are arranged above and below the actuators 10 and 11. Reference numerals 17, 18 and 19 represent selector put-out cams.

Figure 2:
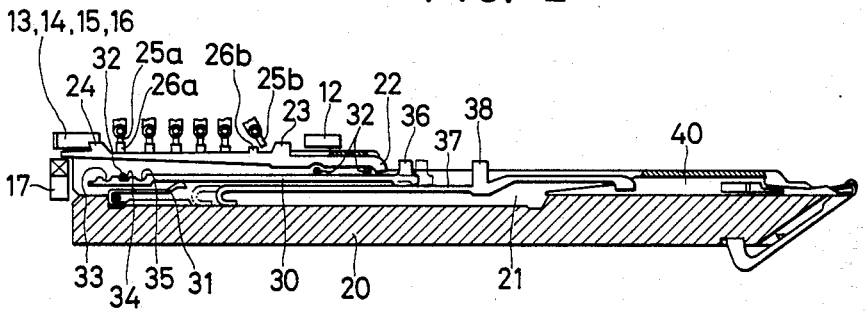
FIG. 2 is a view showing the longitudinal section of a needle bed.

FIG. 2 is a view showing the section of a needle bed. Reference numeral 20 represents a needle bed, and a selector 22, a selector jack 30, a jack 37 and a knitting needle 40 are slidably inserted in a needle groove 21 formed on the top face of the needle bed 20. In the present embodiment, the jack 37 and knitting needle 40 are independently constructed. However, they may be integrated with each other. The selector 22 comprises a butt 23 to be butted against the selector guide cam 12, a butt 24 to be butted against the selector guide cams 13, 14, 15 and 16 and butts 26 to be butted against projections 25 of the selector actuators 10 and 11. In the present embodiment, six butts 26 are disposed at six different positions between the butts 23 and 24. Namely, there are disposed six kinds of selectors. The select jack 30 is always pressed in a direction separating from the needle groove by a spring 31 and is kept in pressing contact with a wire 32. Concave portions 32, 34 and 35 are formed on the ends of the select jack 30 and wires 32 are fitted in these concave portions to effect positioning of the select jack 30. When the selector 22 is raised by the selector guide cams 13, 14 and 15 and 16, a butt 36 is brought into abutting contact with the top end of the selector 22, and when the select jack pressers 6, 7, 8 and 9 are projected, the butt 36 is pressed by these pressers. The jack 37 comprises a butt 38 to be butted against needle operating cams such as the knitting cams 2 and 3 and the raising cam 4, and the top end thereof is engaged and integrated with a knitting needle 40. The intermediate portion of the jack 37 is brought into contact with the head of the select jack 30, and when the jack 37 is pressed by the select jack 30, the side portion of the jack 37 is bent into an L-figured shape by the elasticity thereof to lower the position of the head of the butt 38.

Figure 3:
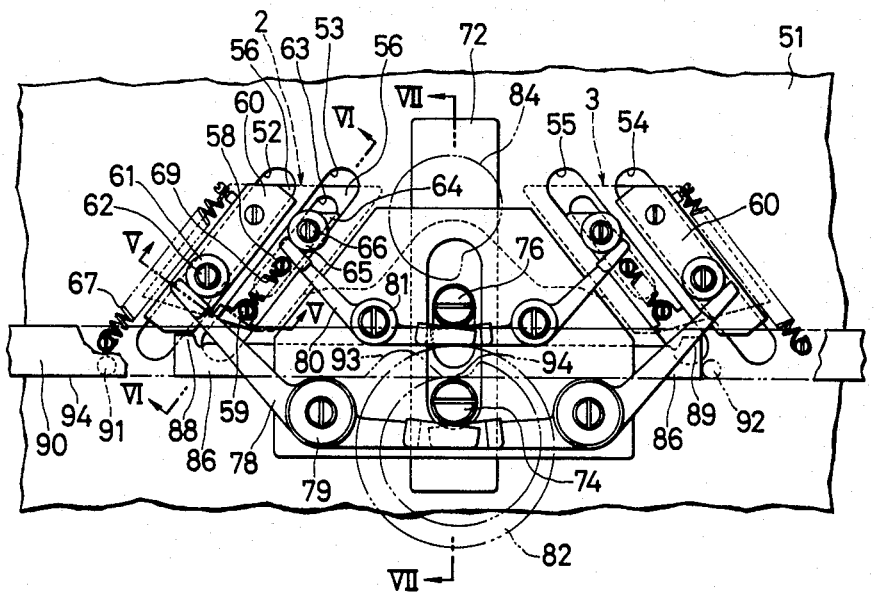
FIG. 3 is a partially cut-out top plan view showing a loop size-changing apparatus.
Figure 4:
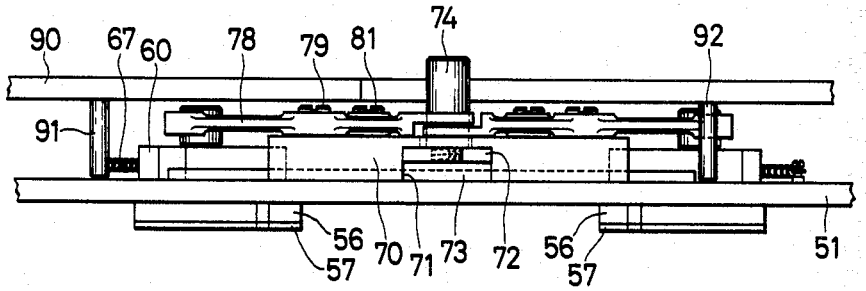
FIG. 4 is a front view of the apparatus shown in FIG. 3.
Figure 5:
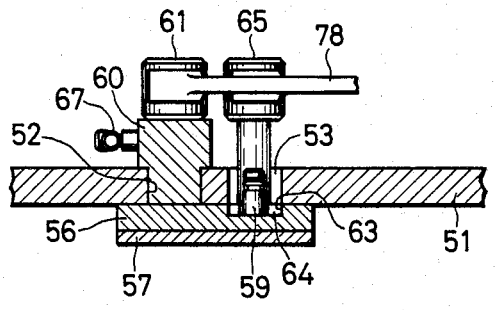
FIG. 5 is a view showing the section taken along the line V—V in FIG. 3.
Figure 6:
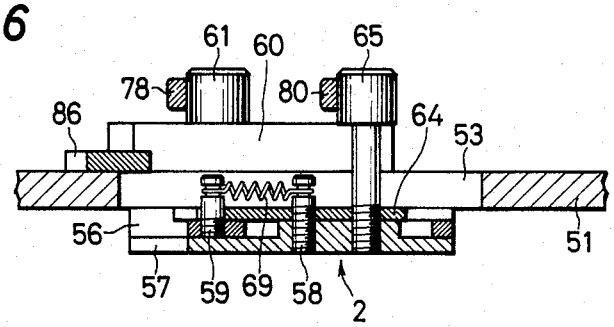
FIG. 6 is a view showing the section taken along the line VI—VI in FIG. 3.

The knitting cams 2 and 3 and a lift mechanism therefor will now be described. FIG. 3 is a partially cut-out top plan view of the carriage. Laterally symmetric parts of the knitting cams 2 and 3 and the lift mechanisms are represented by the same reference numerals, and only the knitting cam 2 is explained while omitting explanation of the knitting cam 3. Reference numeral 51 represents a base bar of the carriage. The knitting cam 2 is guided by two parallel slide grooves 52 and 53, and the knitting cam 3 is guided by two slide grooves 54 and 55 disposed symmetrically with the grooves 52 and 53. Each of the knitting cams 2 and 3 comprises two piled, higher butt cam 56 and lower butt cam 57. The higher butt cam 56 is fixed integrally with a sliding member 60 slidably fitted in the slide groove 52, and a loop size adjusting eccentric collar 61 is fixed to the upper portion of the sliding member 60 by means of a screw 62. A slide groove 63 having the same central line as that of the slide groove 53 is formed on the higher butt cam 56 in parallel to the slide groove 52, and a sliding member 64 is slidably fitted in the groove 63. The sliding member 64 is fixed integrally with the lower butt cam 57. A stitch density adjusting eccentric collar 65 is fixed to the top face of the sliding member 64 by means of a screw 66. A spring 67 is spread between the sliding member 60 and base bar 51 and a spring 69 is spread between a pin 58 implanted on the sliding member 64 and a pin 59 implanted on the higher butt cam 56, so that the sliding members 60 and 64 are always urged downward in FIG. 3.

A raising cam-controlling lever-supporting member 70 having the same central line as that of the guard cam 1 is formed on the base bar 51. A slide groove 71 is formed on the lower face of the supporting member 70 along the central line thereof, and a stop plate 72 for operation of the knitting cam for higher butts and a stop plate 73 for operation of the knitting cam for lower butts are slidably inserted in the groove 71. A pin 74 is implanted on the stop plate 72 so that the pin 74 is projected upward from a through hole 75 formed on the top face of the supporting member 70. Similarly, a pin 76 is implanted on the top face of the stop plate 73 so that the pin 76 is projected upward from a through hole 77 formed on the stop plate 72 and the through hole 75 of the supporting member 70. Swinging arms 78 and 80 are supported on the top face of the supporting member 70 by shafts 79 and 81, respectively. One end of the swinging arm 78 is butted against the eccentric collar 61 formed on the sliding member 60 of the knitting cam 56 for higher butts and the other end is butted against the pin 74 mounted on the stop plate 72 for operation of the knitting cam for higher butts. One end of the swinging arm 80 is butted against the eccentric collar 65 mounted on the sliding member 64 of the knitting cam 57 for lower butts and the other end is butted against the pin 76 mounted on the stop plate 73 for operation of the knitting cam for lower butts. By this arrangement, the pins 74 and 76 are always urged upward in FIG. 3.

A loop size control cam 82 for the knitting cam for higher butts is mounted above the pin 74 so that the pin 74 is inscribed with the cam 82, and a pulse motor 83 is disposed to rotate the loop size control cam 82 by a certain angle. A loop size control cam 84 for the knitting cam for lower butts is mounted in such a manner that the pin 76 is circumscribed with the cam 84. A pulse motor 85 is disposed to rotate the loop size control cam 84 by a certain angle. A preceding knitting cam stop plate 86 is inserted in a guide groove 87 formed through the raising cam-controlling lever-supporting member 70 and the stop plate 73 for the knitting cam for lower butts and is supported slidably on the base bar 51. The preceding knitting cam stop plate 86 has such a length that when the end 88 of the preceding knitting cam stop plate 86 confronts the sliding member 60 of the knitting cam 2, the end 89 does not confront the sliding member 60 of the knitting cam 3 and when the end 89 confronts the sliding member 60 of the knitting cam 3, the end 88 does not confront the sliding member 60 of the knitting cam 2.

A knitting cam-stopping slide bar 90 is disposed so that when the carriage moves to the left and right reciprocatively, the end portion of the bar 90 impinges against a butting member (not shown) such as a butting lever or cam and the bar 90 is moved to the left and right reciprocatively. Pins 91 and 92 are mounted on the lower face of the bar 90 so that the pins 91 and 92 are butted against the ends 88 and 89 of the preceding knitting cam stop plate 86. The bar 90 has a concave portion 93 on the lower edge at the central part thereof. When the end of the bar 90 is not butted against the butting member (not shown), the bar 90 is kept in the neutral state by a spring or the like so that the concave portion 93 is located at the center.

The operation of the apparatus of the present invention will now be described.

An embodiment in which knitting is carried out in such a manner that in one course, the stitch density is appropriately changed among wales will now be described. In this embodiment, needles of the wales should be pulled down to different degrees by the knitting cam 2 or 3.

If the knitting cam 2 or 3 is at a lowermost position (the knitting cams 2 and 3 can be moved in the vertical direction along the line L by means described hereinafter), the size of loops is largest, and when the knitting cam 2 or 3 is at a topmost position, the size of loops is smallest. When it is desired to obtain a knitted fabric comprising largest stitches and smallest stitches in the mingled state, this can be attained by pulling down the jack 37 by the knitting cam 56 for higher butts for formation of largest stitches and the knitting cam 57 for lower butts for formation of smallest stitches.

When the carriage, a part of the back face of which is shown in FIG. 1, is advanced from the right to the left in FIG. 1, the lower portion of the selector 22 of the needle bed 20 confronting the carriage is first brought into butting contact with the cam 17 with the advance of the carriage, and the selector 22 projects the butts 26 from the needle groove 21. Then, the selector 22 is brought into butting contact with the cam 13, but because of the presence of an inclined face 13*a*, the selector 22 is not raised but is passed over the cam 13, with the result that the selector actuator 10 confronts butts 26*a* and 26*b* of the selector 22. Select jacks corresponding to needles to be raised to the knitting position are divided into two groups according to the size of loops.

More specifically, in case of needles for forming large-size stitches, when the selector 22 is brought close to the selector actuator 10, a projecting element 25*a* of the selector actuator 10 is located according to the memory stored in a memory device (not shown) so that the locus of the projecting element 25*a* is butted against the butt 26*a* of the selector 22 of the needle 40. Accordingly, with the advance of the carriage, the butt 26*a* is butted against the projecting element 25*a* and the selector 22 is caused to sink in the needle groove 21, while the cam face 14*b* of the selector guide cam 14 is not butted against the butt 24 and the selector 22 is inhibited from rising. Accordingly, also the select jack 30 is retained at the original position and the select jack butt 36 is located at a position indicated by line A and is not butted against the select jack presser. Incidentally, it is by the cam not shown in the drawings at the time of forming the preceding course that the butt 36 of the select jack 30 has been located at the position indicated by the line A. Since the select jack butt 36 is not pressed by the select jack presser as described above, the select jack 30 does not press the jack 37. Accordingly, the jack butt 38 does not sink in the needle groove 21 and is kept in the higher butt state. Therefore, the jack butt 38 is butted against cam face of the rising cam 4 and raised up in this state, and also the needle 40 is raised. The jack butt 38 is then brought down by the knitting cam 2, but since the jack butt 38 is most projected in the highest butt state at this point, the higher butt 38 is butted against the knitting cam 56 for higher butts of the knitting cam 2 and the butt 38 is brought down to the lower edge 56*a* of the cam 56 along the peripheral edge thereof. Accordingly, the needle 40 forms a large stitch along a locus X shown in FIG. 1.

In forming small-size stitches, the memory device (not shown) is stored with such a memory that even when the selector actuator 10 is brought close to the selector 22 corresponding to the needle for forming the intended small-size stitch, the projecting element 25*a* of the selector actuator 10 is not operated, and the butt 26*b* is prevented from falling in contact with the advancing locus of the projecting element 25*b*. Accordingly, even if the carriage is advanced, since the selector butt 26*b* is not pressed, the selector 22 does not sink into the needle groove and the cam face 14*b* of the selector guide cam 14 is brought into butting contact with the butt 24, and the selector 22 is raised by the selector guide cam 14 to a position indicated by a one-dot chain line in FIG. 2. The locus of the butt 36 of the select jack 30 is indicated by line B in FIG. 1. The jack butt 36 travelling along the locus B is not pressed by the select jack pressers 8 and 6 because the pressers 8 and 6 are located at inoperative positions. Accordingly, the jack 37 is not pressed into the needle groove by the select jack 30, and the jack butt 38 is retained at the higher butt position. Therefore, the jack butt 38 is butted against the raising cam 4 and raised, and then, lowering of the jack butt 38 by the knitting cam 2 is started. However, at the time of initiation of this lowering movement, the select jack butt 36 is pressed by the select jack presser 9 coming out to the half position and the jack butt 38 is retracted to the lower butt position. Accordingly, the jack butt 38 is brought into contact only with the knitting cam 57 for lower butts of the knitting cam 2. Furthermore, at the time of forming smallest-size stitches, the lower edge 57*a* of the knitting cam 57 for lower butts is raised as shown in FIG. 1 by means described hereinafter. Therefore, the needle 40 forms a small-size stitch along the locus Y according to the lower end edge 57*a* of the knitting cam 57 for lower butts as shown in FIG. 1.

The method of adjusting the stitch density will now be described. In the apparatus according to the present invention, two optional large and small size stitches can be chosen for every course. The large-size stitch is adjusted by the vertical movement of the knitting cam 56 for higher butts in the direction of the line L. More specifically, the sliding member 60 of the knitting cam 56 for higher butts is always pulled downwardly in FIG. 3 by the spring 67 and is urged in a direction increasing the stitch size, and the movement of the sliding member 60 is controlled by the swinging arm 78. Also in the knitting cam 57 for lower butts, the sliding member 64 of the knitting cam 57 is similarly urged in a direction increasing the stitch size by the spring 69 and this downward movement is controlled by the swinging arm 80. The movements of the swinging arms 78 and 80 are controlled by the loop size control cams 82 and 84 through the pins 74 and 76, respectively.

Adjustment of the size of the large stitch is accomplished by rotating the loop size control cam 82 by the motor 83. In the embodiment illustrated in FIG. 3, the rectangular portion of the loop size control cam 82 is brought into contact with the pin 74 and the pin 74 is located at the lowermost position. However, if the cam 82 is rotated and the pin 74 is brought into contact with the long-diameter portion of the cam 82, the swinging arm 78 is turned counterclockwise in FIG. 3 in a quantity compensating the difference by the elastic force of the spring 67, and the sliding element 60 slides downward in FIG. 3 in the slide groove 52. Accordingly, also the knitting cam 56 for higher butts are moved downward to increase the stitch size.

In order to adjust the size of the small stitch, the swinging angle of the swinging arm 80 is adjusted by rotating the loop size control cam 84 in the same manner as described above, and the sliding element 64 is displaced in the slide groove 63 through the eccentric collar 65. This displacement is accomplished by the elastic force of the spring 68, whereby the knitting cam 57 for lower butts, which is integrated with the sliding element 64, is displaced together with the sliding member 64.

In case of each of large-size and small-size stitches, the degree of displacement is adjusted by appropriately selecting the rotation angle of the cam.

Figure 7:
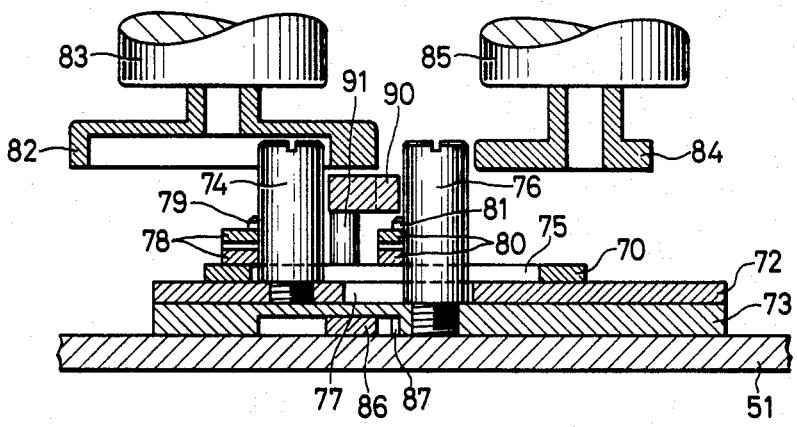
FIG. 7 is a view showing the section taken along the line VII—VII in FIG. 3.

Change of the stitch size is carried out when the carriage is transferred to either of both the ends of the needle bed. More specifically, when the carriage is transferred to one end of the needle bed, the knitting cam stop slide bar 90 is brought into contact with the impinging member mounted on the end of the machine frame for example, the butting lever and is caused to slide to the left or right. In the embodiment illustrated in FIG. 3, the carriage is moved to the right and on the travel end of the carriage, the knitting cam stop slide bar 90 is shifted and located at a position deviated to the left from the neutral position. By this shifting of the knitting cam stop slide bar 90, the pin 92 is butted against the right end 89 of the preceding knitting cam stop plate 86 to shift the stop plate 86 to the left from the neutral position and the left end 88 of the preceding knitting cam stop plate 86 is located on the lowering locus of the sliding element 60 of the preceding knitting cam 2. By the above movement, the right end 89 of the preceding knitting cam stop plate 86 is deviated from the lowering locus of the sliding member 60 of the knitting cam 3 and the sliding member 60 of the knitting cam 3 makes no hindrance to the lowering movement. Simultaneously, by the transfer of the knitting cam stop slide bar 90, the pin 74 inserted in the central concave portion 93 of the bar 90 is caused to come out from the concave portion 93 and is butted against the lower edge 94 of the bar 90 and pushed downward in FIG. 3. Accordingly, the knitting cam stop plate 72 for higher butts, which is integrated with the pin 74, and the knitting cam stop plate 73 for lower butts, which is integrated with the pin 76 located in the through hole 77 of the stop plate 72, are pushed downward in FIG. 3 and leftward in FIG. 7. By the above operation, the swinging arms 78 and 80 raise the knitting cams 56 and 57 for higher butts and lower butts to the uppermost positions, and simultaneously, the pins 74 and 76 are cut from contact with the loop size control cams 82 and 84. At this point, by rotating the pulse motors 83 and 85 by predetermined angles according to the memory stored in the memory device not shown in the drawings, the loop size control cams 82 and 84 are set at positions corresponding to the predetermined stitch sizes.

After completion of the above operation, if the carriage is shifted (to the left in the embodiment shown in FIG. 3), the knitting cam stop slide bar 90 is returned to the neutral position by the mechanism not shown in the drawings and the concave portion 93 is located at the center. Accordingly, the pin 74 is inserted in the concave portion 93, the stop plates 72 and 73 for the knitting cams for higher butts and lower butts are released from inhibition from rising movements, and the pins 74 and 76 receive elastic forces of the springs 67 and 68 through the swinging arms 78 and 80 and are butted against the loop size control cams 82 and 84, whereby the positions of the knitting cams 56 and 57 for higher butts and lower butts of the knitting cam 3 are determined. However, in the preceding knitting cam 2, since the end 88 of the preceding knitting cam stop plate 86 is butted against the sliding element 60 of the knitting cam 2, the lowering movement of the sliding member 60 is inhibited and therefore, both the knitting cam 56 for higher butts and the knitting cam 57 for lower butts are fixed at elevated positions.

When the carriage is shifted to the left end of the needle bed, according to the procedures contrary to the above-mentioned procedures, the knitting cam stop slide bar 90 is butted against the impinging member not shown in the drawings and moved to the right. Simultaneously, also the knitting cam stop plate 86 is pushed by the pin 91 to perform operations according to procedures contrary to those described above.

In the foregoing embodiment, minute adjustment of the stitch size is accomplished by turning the screws 62 and 66 to change contact positions of the eccentric collars 61 and 65 with the swinging arms 78 and 80.

What is claimed is:

1. A flat knitting machine including a needle bed having a plurality of needle grooves therein, needles in the needle grooves, a carriage positioned over the needle bed for movement thereacross and engagement with selected needles on the needle bed to effect knitting of different size stitches and means for changing stitch size comprising selector means positioned on the needle bed for selecting predetermined needles in the needle grooves for movement to an upper and a lower position, means carried by the carriage and engageable with the selected needles for moving the selected needles to the upper or lower position, cam means engageable with the selected needles in the upper or lower position to effect knitting different size stiches therewith and means for adjusting the cam means to vary the size of the stitches effected by the selected needles engaged with the cam means.

2. Structure as set forth in claim 1, wherein the selector means includes a jack engaged with a needle in a needle groove on the needle bed, a select jack positioned over the jack in the needle groove having one end engaged with the jack centrally of the jack, means for preventing movement of the select jack out of the slot, a selector positioned in the needle groove above the select jack for varying the position of the select jack longitudinally of the groove, selector guide cams on the carriage for positioning the selector axially of the needle groove, selector actuators positioned adjacent the selectors on the carriage and selectively operable to make the selector in the groove to position the selector with respect to a selector guide cam to vary the axial position thereof and thus the axial position of the selector jack in the groove on movement of the carriage past the groove and selector jack pressers on the carriage for pressing the select jack with the select jack in a predetermined axial position within the groove whereby the jack is deformed to vary the position of a jack abutment between an inner and outer jack abutment position.

3. Structure as set forth in claim 2, wherein the jack is elastic whereby after being deformed by the select jack it tends to return to its original configuration.

4. Structure as set forth in claim 2, and further including resilient means positioned within the needle groove tending to urge the select jack out of the needle groove.

5. Structure as set forth in claim 2, wherein the needle and jack are a single member.

6. Structure as set forth in claim 1, wherein the cam means engageable with the selected needles in the upper or lower position to effect knitting comprises a raising cam and guard cam on the carriage for receiving and guiding the jack butts during knitting and knitting cam means on each side of the guard cam having separate upper and lower knitting cams for variably guiding the jack butts positioned in an upper and lower position to provide variable size stitches.

7. Structure as set forth in claim 6, wherein the upper knitting cam of the knitting cam means include a carriage base bar having a slot therein, an upper knitting cam positioned on one side of the base bar over the slot, an upper knitting cam slide extending over the other side of the base bar and through the slot into engagement with the upper knitting cam and an uppper knitting cam post on the upper knitting cam slide for holding the upper knitting cam in an adjusted position.

8. Structure as set forth in claim 7, and further including resilient means positioned between the upper knitting cam slides and the base bar for urging the upper knitting cams in one direction.

9. Structure as set forth in claim 8, wherein the lower knitting cam of the knitting cam means include a lower knitting cam, an opening through the upper knitting cam, a groove in the top of the upper knitting cam, a lower knitting cam slide in the groove in the upper knitting cam and a lower knitting cam post and means for securing the lower knitting cam post to the lower knitting cam slide whereby the lower knitting cam may be moved along the slot in the upper knitting cam post relative to the upper knitting cam.

10. Structure as set forth in claim 9, and further including resilient means positioned between the upper knitting cam and lower knitting cam slide for urging the lower knitting cam in one direction.

11. Structure as set forth in claim 1, wherein the means for adjusting the stitch size includes means engageable with the posts for holding the upper and lower knitting cams in an adjusted position and means connected to the means for holding the upper and lower knitting cams in an adjusted position for varying the adjusted position.

12. Structure as set forth in claim 11, wherein the means for holding the upper knitting cam in an adjusted position includes a centrally pivoted upper knitting cam lever, one end of which is in engagement with the upper knitting cam post and an adjustable post engaged with the other end of the upper knitting cam lever.

13. Structure as set forth in claim 11, wherein the means for holding the lower knitting cam in an adjusted position includes a centrally pivoted lower knitting cam lever, one end of which is in engagement with the lower knitting cam post and an adjusable post engaged with the other end of the lower knitting cam lever.

14. Structure as set forth in claim 12, wherein the means for adjusting the stitch size includes an eccentric cam sleeved over the upper knitting cam post in engagement with the one end of the upper knitting cam lever.

15. Structure as set forth in claim 12, wherein the means for adjusting the stitch size includes an arcuate internal cam member positioned over the adjustable post and a motor connected to the internal cam for selectively rotating the internal cam to vary the position of the adjustable post.

16. Structure as set forth in claim 13, wherein the means for adjusting the stitch size includes an eccentric cam sleeved over the lower knitting cam post in engagement with the one end of the lower knitting cam lever.

17. Structure as set forth in claim 13, wherein the means for adjusting the stitch size includes an arcuate external cam member positioned adjacent the adjustable post and a motor connected to the external cam for selectively rotating the external cam to vary the position of the adjustable post.

18. Structure as set forth in claim 11, wherein the means for varying the adjusted position of the knitting cams further includes a knitting cam stop plate having an arcuate recess in one side thereof receiving one of said adjustable posts means for moving the stop plate relative to the one adjustable post to move the one adjustable post out of the recess in the stop plate and to move both of said adjustable posts out of engagement with the associated cams to permit adjustment of the associated cams out of contact with the adjustable posts and a slide bar having stop pins thereon operable to stop the movement of the stop plate in both directions of movement thereof with one end of the stop plate in engagement with one of the pins and the other end of the stop plate in engagement with one of the knitting cams for restricting movement of the one knitting cam.

19. A flat knitting machine including at least one needle bed having a plurality of needle grooves therein a needle positioned in at least one of the needle grooves a jack within the needle groove in engagement with the needle for moving the needle longitudinally of the groove a select jack within the needle groove over the jack, pins retaining the select jack within the needle groove, resilient means urging the select jack out of the needle groove, one end of said select jack being in contact with the jack for deforming the jack inwardly of the needle groove to variably position a jack butt in a high or low position, a selector positioned within the needle groove; means engageable with the selector for moving the selector axially of the needle groove to move the select jack axially of the needle groove, a carriage movable over the needle bed including cam means for raising one end of the selector, selector actuating means for engaging butts on the selector to variably position the selector for selective engagement by a selector cam on the carriage whereby the selector is variably positioned axially of the needle groove on movement of the carriage past the needle groove to axially position the select jack in a high and low position in the needle groove and select jack pressers on the carriage for selectively engaging a select jack butt to selectively deform the jack to position the jack butt in high and low positions, a raise cam on the carriage and a guard cam for engaging the jack butt and moving the jack in a selected path to move the needle longitudinally in the needle groove and cam means on each side of the cam guard for guiding the jack butt including upper and lower cam members for engaging the jack butt to provide different size stitches including means for biasing the cams in a direction to increase the size of the stitches and means for limiting the movement of the upper and lower cams in the direction to increase the size of the stitches including a pivoted lever arm in engagement with each of the upper and lower cam means at one end and in engagement with an adjustable post at the other end and means for adjusting the position of the adjustable posts at the other ends of the arms including rotatable cams in engagement with the posts at the other ends of the arms for restricting movement of the posts in accordance with the angular position of the rotatable cams and means for angularly adjusting the positions of the rotatable cams comprising a stop plate having an arcuate recess on one side thereof engaged with one of the adjustable posts in a neutral position of the stop plate, a slide bar including stop means for stopping the stop plate in movement in either direction from its neutral position in which the adjustable posts are moved out of contact with the rotatable cam means and for limiting movement of the knitting cams on one side of the adjustable posts and motor means for selectively rotating each of the rotatable cams independently while it is out of engagement with the adjustable posts to adjust the stitch sizes.

20. Structure as set forth in claim 19, wherein the means for adjusting the stitch size further includes an eccentric cam sleeved over each of the posts secured to the upper and lower cam and means for angularly adjusting the eccentric sleeve about the posts.

* * * * *

UNITED STATES PATENT AND TRADEMARK OFFICE

CERTIFICATE OF CORRECTION

PATENT NO. : 4,510,775

DATED : April 16, 1985

INVENTOR(S) : Masahiro Shima

It is certified that error appears in the above-identified patent and that said Letters Patent are hereby corrected as shown below:

Col. 8, Line 21, change "make" to -- move --.

Col. 8, Line 61, change the dependency of the claim from "8" to -- 6 --.

Signed and Sealed this

*Sixth* Day of *August 1985*

[SEAL]

*Attest:*

DONALD J. QUIGG

*Attesting Officer* *Acting Commissioner of Patents and Trademarks*